US006488547B2

(12) United States Patent
Tanaka

(10) Patent No.: US 6,488,547 B2
(45) Date of Patent: Dec. 3, 2002

(54) CONNECTOR WITH LONGITUDINALLY SPACED LOCKS FOR RETAINING TERMINAL FITTINGS

(75) Inventor: Tsutomu Tanaka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/907,319

(22) Filed: Jul. 17, 2001

(65) Prior Publication Data

US 2002/0013104 A1 Jan. 31, 2002

(30) Foreign Application Priority Data

Jul. 24, 2000 (JP) ..... 2000-222609

(51) Int. Cl.[7] ..... H01R 13/514
(52) U.S. Cl. ..... 439/752; 439/595
(58) Field of Search ..... 439/752, 595

(56) References Cited

U.S. PATENT DOCUMENTS 5,252,096 A * 10/1993 Okada ..... 439/752
5,358,427 A * 10/1994 Miwa ..... 439/595
5,437,565 A * 8/1995 Atsumi et al. ..... 439/752
5,618,207 A * 4/1997 Maejima ..... 439/595
5,797,772 A * 8/1998 Sakurai et al. ..... 439/752
6,000,967 A 12/1999 Norizuki et al. ..... 439/596

FOREIGN PATENT DOCUMENTS

| | | |
|---|---|---|
| EP | 0 929 124 | 7/1999 |
| GB | 2 288 494 | 10/1995 |
| JP | 10-40994 | 2/1998 |

* cited by examiner

*Primary Examiner*—Gary Paumen
*Assistant Examiner*—Ann McCamey
(74) *Attorney, Agent, or Firm*—Anthony J. Casella; Gerald E. Hespos

(57) ABSTRACT

A connector (F) includes two partial locks (41) for holding a terminal retainer (15) in a partial locking position with respect to a housing (Fh) and two full locks (42) for holding the terminal retainer (15) in a full locking position. Terminal fittings (5) can be inserted longitudinally into the housing (Fh) when the retainer (15) is in the partial locking position, but are a locked in the housing (Fh) when the retainer (15) is in the full locking position. The partial locks (41) are on opposite sides of the housing (Fh) and are spaced longitudinally. Similarly, the full locks (42) are on opposite sides of the housing (Fh) and are spaced apart longitudinally. The spaced disposition of the locks (41, 42) stabilizes the retainer (15) in response to forces exerted longitudinally of the terminal fittings (5).

9 Claims, 11 Drawing Sheets

CONNECTOR WITH LONGITUDINALLY SPACED LOCKS FOR RETAINING TERMINAL FITTINGS

BACKGROUND OF THE INVENTION

1. Field of the Invention

The present invention relates to a connector with a housing, terminal fittings in the housing and a terminal retainer for holding the terminal fittings in the housing.

2. Description of the Related Art

Japanese Unexamined Patent Publication No. 10-40994 discloses a connector with a housing and a plurality of terminal fittings inserted side by side into the housing from behind. A terminal retainer can be mounted in the housing to engage with the terminal fittings and to prevent the terminal fittings from coming out of the housing. The terminal retainer is held in the housing by two locking means that are laterally spaced apart, but that are in the same position with respect to the insertion direction of the terminal fittings. Thus, an external force that acts in a direction to withdraw the terminal fittings from the housing also acts on the terminal retainer. As a result, the terminal retainer may be inclined with respect to the insertion and withdrawal directions of the terminal fittings about the locking position of the locking means.

In view of the above situation, an object of the present invention is to stabilize the orientation of a terminal retainer mounted into a housing.

SUMMARY OF THE INVENTION

The invention is directed to a connector that comprises a housing with opposite front and rear ends, a top, a bottom and opposite sides. At least one side-by-side array of cavities extends through the connector housing from the front end to the rear end. The connector further comprises terminal fittings that preferably are inserted into the cavities in a rear-to-front direction. A terminal retainer is mountable in the housing to prevent the terminal fittings from coming out of the housing. At least two locking means are provided to lock the terminal retainer in the housing. The locking means are at different positions relative to the front and rear ends of the housing. As a result, the orientation of the terminal retainer is not inclined with respect to the front and rear ends even if a forward or rearward external force acts on the terminal retainer.

According to a preferred embodiment of the invention, the two locking means are disposed respectively on forward and rearward sides of an engaging position of the terminal retainer with the terminal fittings. As a result, the terminal retainer will not incline when an external force acts on the terminal fittings in the insertion or withdrawal direction of the terminal fittings.

The locking means preferably comprises a pair of partial locking means for holding the terminal retainer in a partial locking position that permits insertion of the terminal fittings into the housing and withdrawal of the terminal fittings from the housing. The locking means preferably further comprises a pair of full locking means for holding the terminal retainer in a full locking position where the terminal retainer engages the terminal fittings to prevent the terminal fittings from coming out of the housing. The partial locking means at one lateral side preferably is more forward than the full locking means with respect to the insertion direction. However, the partial locking means at the other side is more backward than the full locking means with respect to the insertion direction. The spacing of the partial and full locking means in the insertion and withdrawal directions of the terminal fittings, avoids interference between the partial and full locking means in arranging the respective locking means and provides a higher degree of design freedom.

The terminal retainer preferably comprises a terminal lock provided in such a position that a distance from an inner surface of the housing and/or of a front stop wall of the retainer to a front surface of the terminal lock is substantially equal to an entire length of a connecting portion of the terminal fitting.

The partial lock and/or the full lock may comprise a pair of locking projections on one of the retainer and the housing and a locking hole on the other of the retainer and the housing. The locking projections cooperate with the locking hole in the partial and/or full locking position of the retainer. The locking hole preferably is oblong along an insertion and withdrawal direction of the retainer in and from the female housing. As a result, a partial locking projection is engageable with a bottom edge of the corresponding locking hole when the terminal retainer is in its partial locking position, while the partial locking projection is at an intermediate position of the locking hole when the terminal retainer is in its full locking position. Additionally, or alternatively, a full locking projection is engageable with a stepped portion below a bottom end of the opening edge of the corresponding locking hole when the terminal retainer is in the partial locking position while the partial locking projection is locked in the locking hole when the terminal retainer is in its full locking position.

According to a further preferred embodiment, the housing comprises at least one lock arm resiliently engageable with a mating connector for locking the connector with the mating connector. The lock arm comprises a locking projection with at least one shake-preventing portion for contacting a portion of the mating connector to avoiding shaking of the connectors. Preferably, the shake preventing portions comprise slanted surfaces.

These and other objects, features and advantages of the present invention will become apparent upon reading of the following detailed description of preferred embodiments and accompanying drawings.

DETAILED DESCRIPTION OF THE PREFERRED EMBODIMENT

Figure 1:
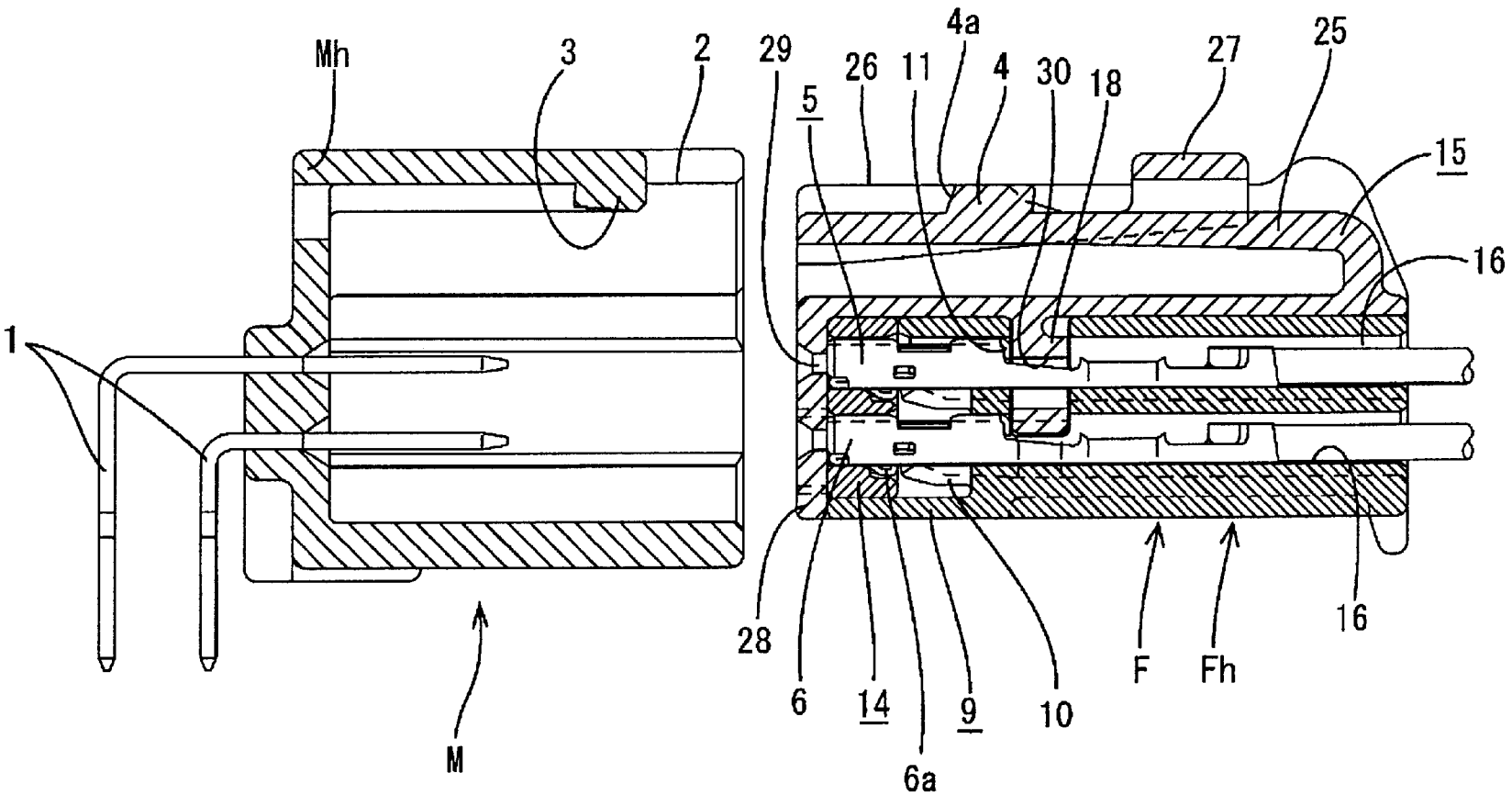
FIG. 1 is a side view in section showing a male connector housing and a fully locked female connector housing.

FIG. 1 shows a female connector F according to the invention and a mating male connector M to be connected with the female connector F. The male connector M has a housing Mh in the form of a substantially rectangular tube that is open forward, and male terminal fittings 1 are pressed into a back wall of the housing Mh. One side of each male terminal fitting 1 projects rearwardly beyond the male connector M, and is bent down at right angles for connection with a wiring on an unillustrated printed circuit board. A recess 2 is formed in the middle of the upper surface of the housing Mh and extends rearward from an opening edge of the housing Mh. An engaging projection 3 projects down at the back of the recess 2 and is engageable with a lock 4 of the female connector F.

Figure 19:
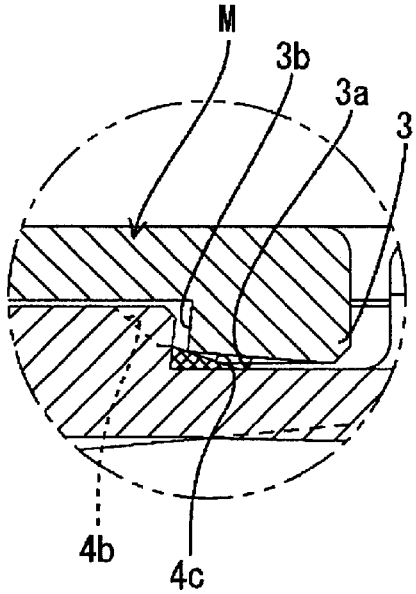
FIG. 19 is an enlarged section showing an engaged state of a locking projection and an engaging projection.

The bottom of the engaging projection 3 defines a slanted surface 3*a* that is inclined upward from its outer side to its inner side, as shown in FIG. 19. The engaging projection 3 further has a locking surface 3*b* that faces the lock 4 during locking and is formed to overhang slightly.

The female connector F has a housing Fh, and female terminal fittings 5 are arranged transversely substantially side by side in the housing Fh. A terminal retainer 15 is inserted into the housing Fh at an angle to the insertion and withdrawal directions of the female terminal fittings 5 and at an angle to the lateral direction JD in FIG. 14 for preventing the inserted female terminal fittings 5 from coming out of the housing Fh. The terminal retainer 15 is held in the housing Fh at a partial locking position and a full locking position by partial locking means 41 and full locking means 42 to be described later.

Figure 2:
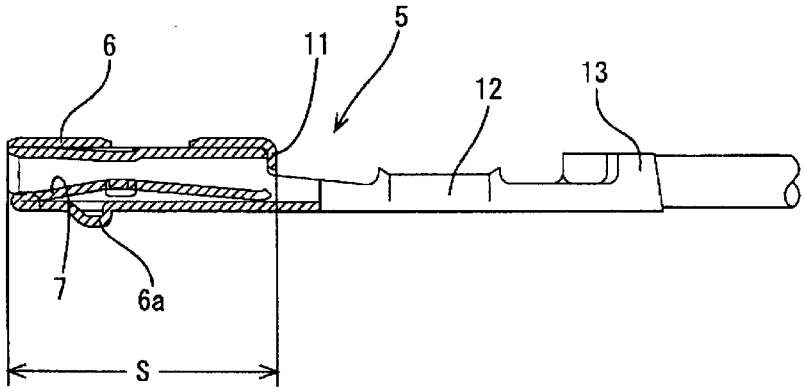
FIG. 2 is a side view in section of a female terminal fitting.
Figure 3:
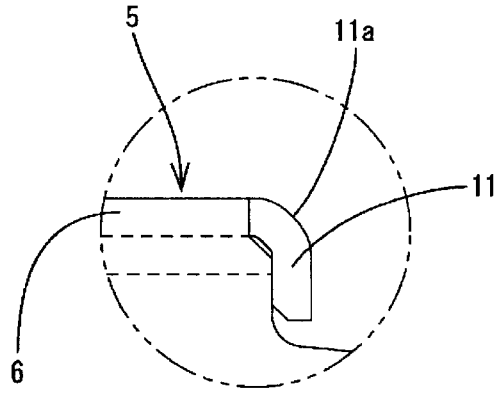
FIG. 3 is an enlarged view showing a contact piece of the female terminal fitting.

Each female terminal fitting 5 has a leading end that defines a substantially rectangular tubular connecting portion 6, as shown in FIG. 2. The corresponding male terminal fitting 1 can be inserted into the female terminal fitting 5 during connection of the female and male connectors F, M. An elastic or resilient piece 7 is formed inside the connecting portion 6 by triangularly folding a projecting portion at the front end of the bottom wall of the female terminal fitting 5. The elastic piece 7 can be brought elastically or resiliently into contact with the male terminal fitting 1. A locking projection 6*a* is formed integrally or unitarily with the bottom surface of the connecting portion 6 and projects downward for engagement with a lock 10 of a housing body 9 to be described later. A contact piece 11 is formed at the rear end of the connecting portion 6, as shown in FIG. 3. The contact piece 11 is formed by bending the upper end of the rear end of the connecting portion 6 down or towards a centerline of the female terminal fitting 5. A downwardly sloped guide surface 11*a* is formed on the upper surface of the bent portion for guiding a locking operation by a terminal lock 18 of the terminal retainer 15.

A core barrel 12 is provided behind the connecting portion 6 and can be crimped, bent or folded into connection with a core of a wire. An insulation barrel 13 is behind the core barrel 12, and can be crimped, bent or folded into connection with an insulation coating of the wire.

Figure 4:
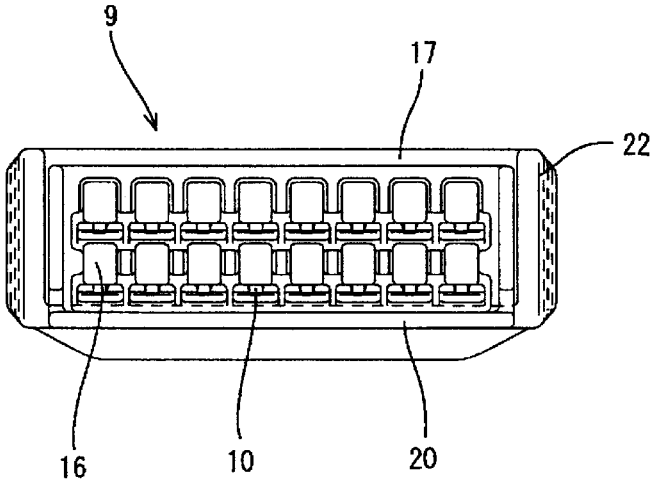
FIG. 4 is a front view of a housing.
Figure 5:
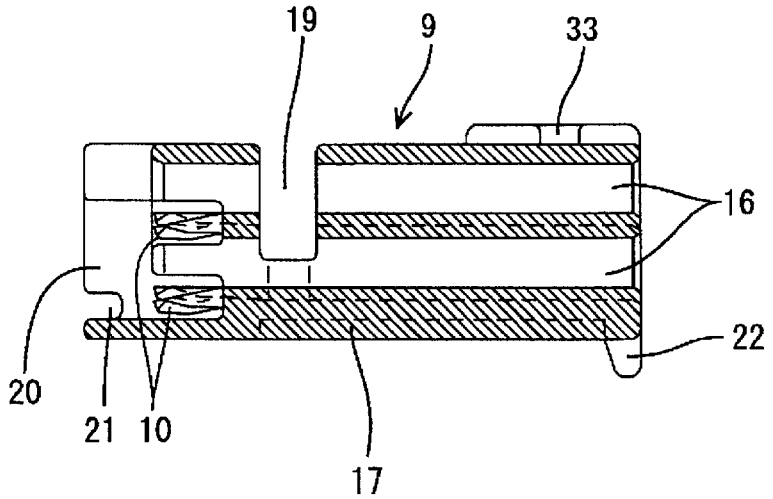
FIG. 5 is a side view in section of the housing.
Figure 6:
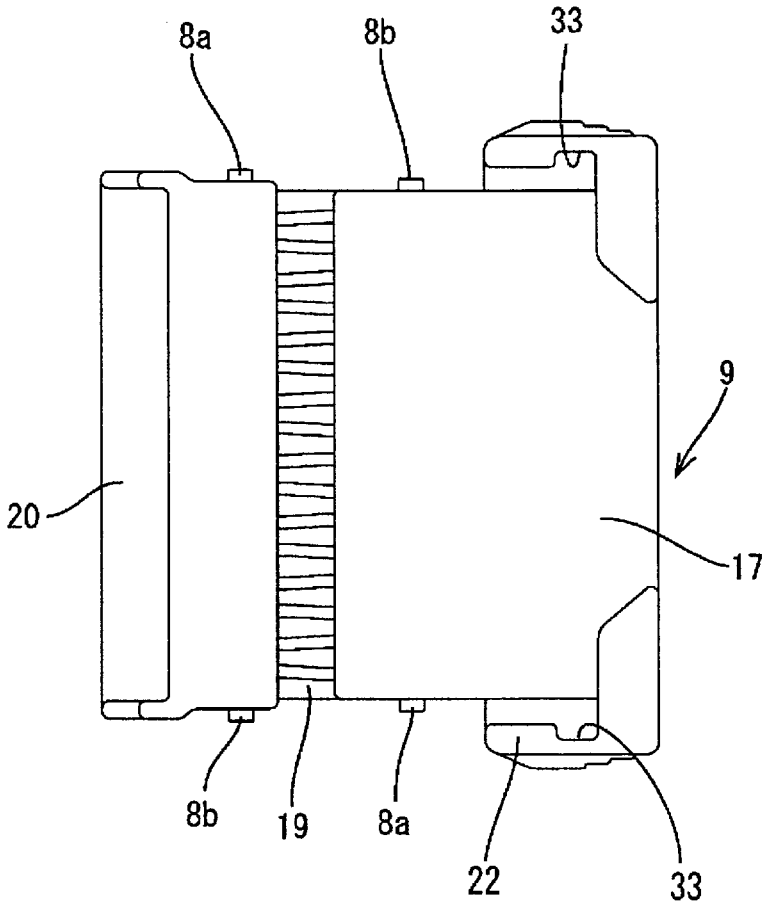
FIG. 6 is a plan view of the housing.

The housing Fh of the female connector F is comprised of the housing body 9, a housing head 14 and the terminal retainer 15. The housing body 9 has a main body 17 that defines a wide substantially rectangular parallelepiped, as shown in FIGS. 4 to 6. Cavities 16 are arranged substantially side by side at upper and lower stages in the main body 17 and penetrate the main body 17 in forward and backward directions. The cavities are dimensioned to accommodate the female terminal fittings 5, such that the female terminal fittings 5 are in close contact with substantially the entire circumferential surfaces of the cavities 16. A lock 10 is formed at the bottom surface of the front end of each cavity 16, and is elastically or resiliently deformable in a vertical direction or away from the cavity 16. The lock 10 is deformed to permit passage of the female terminal fitting 5 into the cavity. After the passage, the lock 10 is restored elastically to engage the locking projection 6*a* of the female terminal fitting 5.

A mount hole 19 is formed from the upper surface over to the opposite side surfaces of the main body 17 of the housing body 9 for receiving the terminal lock 18 of the terminal retainer 15. The mount hole 19 is formed so that the rear end surfaces of the contact pieces 11 are aligned substantially with the front opening edge of the mount hole 19 when the female terminal fittings 5 are accommodated properly in the housing body 9.

A bulging portion 20 bulges out at the front end of the main body 17 and substantially surrounds front parts of the respective locks 10. The bulging portion 20 is open forward and upward, and the housing head 14 to be described later can be accommodated therein. Notches 21 are formed at the bottom corners of the opposite side surfaces of the bulging portion 20 to prevent detachment of the housing head 14.

An operable portion 22 bulges out at the rear end of the main body 17, and is used to connect and disconnect the female and male connectors F, M. Two substantially vertical guide grooves 33 are formed in the inner surfaces of the opposite sides of the operable portion 22, and coupling projections 34 of the terminal retainer 15 are slidably engageable with the guide grooves 33 to assemble the terminal retainer 15 with the housing body 9.

Figure 7:
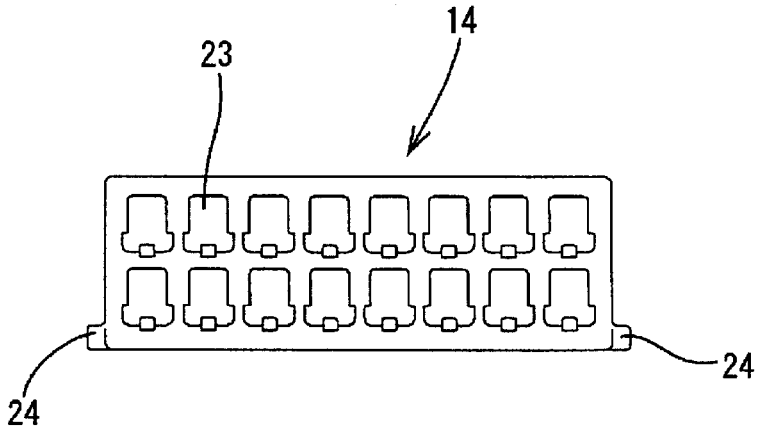
FIG. 7 is a front view of a housing head.
Figure 8:
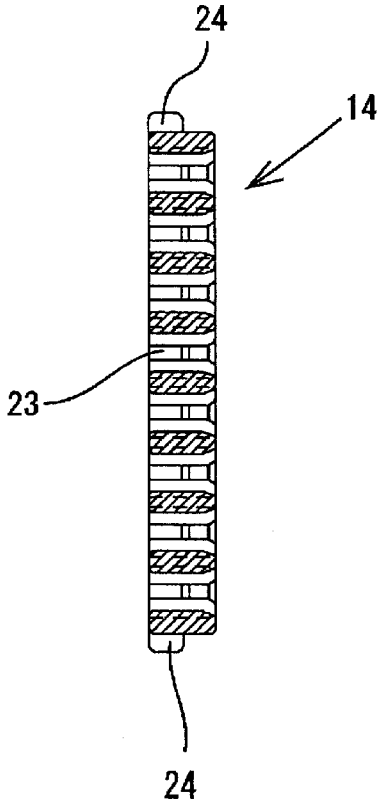
FIG. 8 is a plan view in section of the housing head.

The housing head 14 is accommodated in the bulging portion 20 of the main body 17 and aligns substantially with the back surface of the bulging portion 20. As shown in FIGS. 7 and 8, the housing head 14 has a lattice shape that defines a plurality of windows 23. The windows 23 communicate with the corresponding cavities 16 when the housing head 14 is accommodated in the bulging portion 20. Hooks 24 project at the bottom of the opposite outer side surfaces of the housing head 14. The hooks 24 engage the notches 21 of the bulging portion 20 when the housing head 14 is accommodated in the bulging portion 20 from front to prevent the housing head 14 from coming out upward or laterally.

Figure 9:
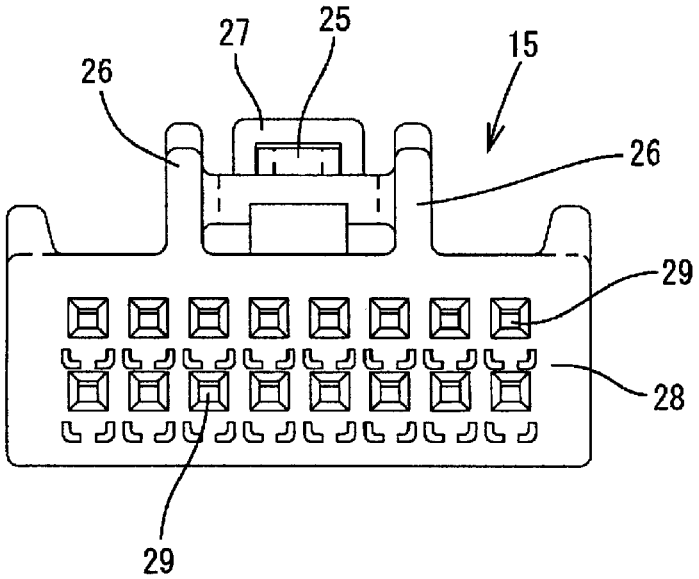
FIG. 9 is a front view showing a terminal retainer.
Figure 10:
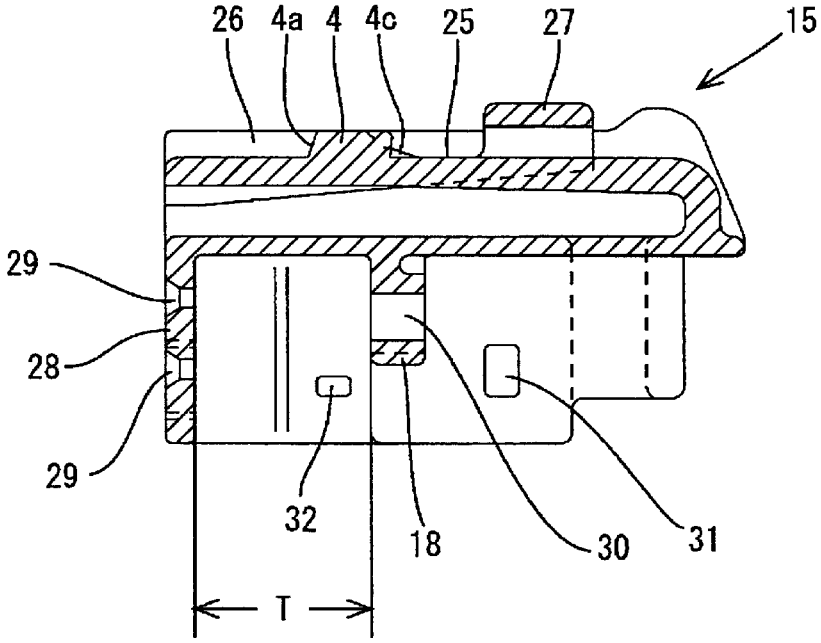
FIG. 10 is a side view in section of the terminal retainer.
Figure 11:
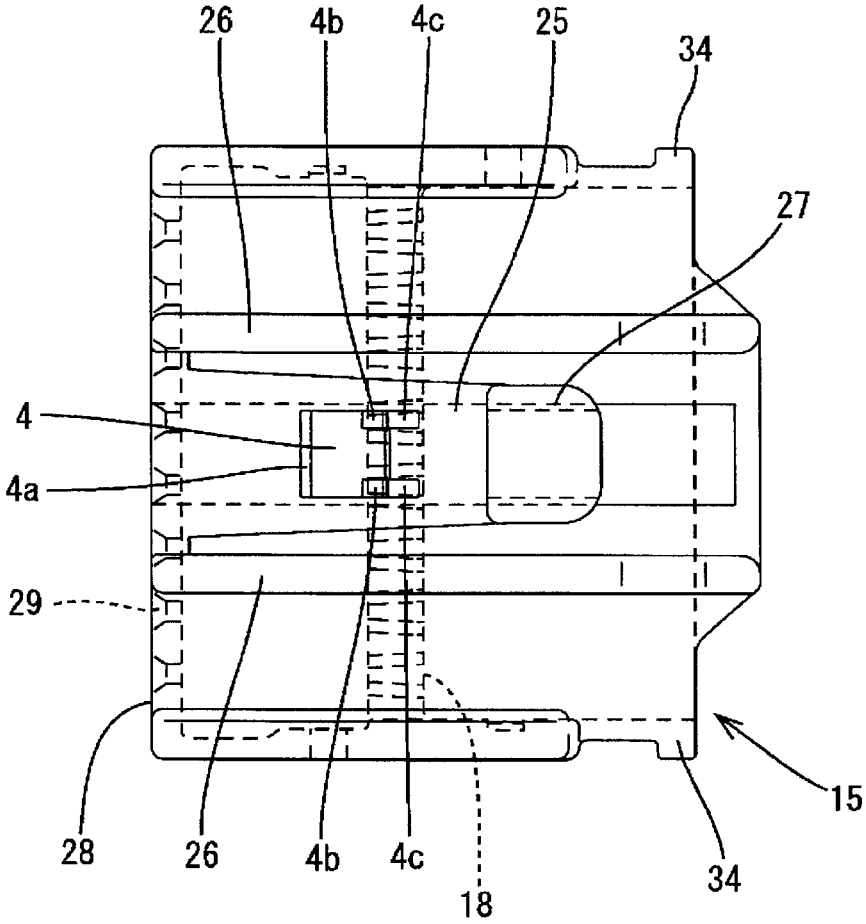
FIG. 11 is a plan view of the terminal retainer.

The terminal retainer 15 is substantially in the form of a box that is open downward and backward, as shown in FIGS. 9–11, and can be fit to the housing body 9 from above. A lock arm 25 extends along forward and backward directions on the upper surface of the terminal retainer 15, and is configured for locking the female and male connectors F, M into each other. A lock 4 projects from a position slightly forward of the center of the upper surface of the lock arm 25. The rear end of the lock arm 25 is connected with the upper surface of the terminal retainer 15 while the front end thereof is connected with substantially parallel protection walls 26 disposed at opposite sides of the lock arm 25. Thus, the lock arm 25 is supported at both the front and rear ends and can be engaged with the engaging projection 3 of the male connector M after elastic or resilient deformation in a vertical direction towards or away from the female housing Fh. An unlocking piece 27 projects in a position behind the lock 4 on the upper surface of the lock arm 25 and is used for unlocking. The lock arm 25 can be deformed elastically or resiliently in an unlocking direction (downward) by pushing the unlocking piece 27.

The lock 4 has an upwardly sloped sliding surface 4*a* inclined toward the leading end of the lock arm 25. The sliding surface 4*a* can guide the lock arm 25 for elastic or resilient downward deformation in response to contact with the front surface of the engaging projection 3 during the connection of the female and male connectors F, M. Two shake preventing portions 4*c* are arranged transversely at the base of a surface of the lock 4 opposite the sliding surface 4*a*, which is the surface that engages the engaging projection 3. The shake preventing portions 4*c* fill a clearance between the lock 4 and the engaging projection 3 when the female and male connector housings are connected.

The lock arm 25 is deformed down or toward the terminal retainer 15 so that the lock 4 passes under the engaging projection 3 during the connection of the female and male connectors F, M. The lock then is elastically or resiliently restored to engage the lock 4 and the engaging projection 3 into each other when the female and male connectors F, M are properly connected (see FIG. 19). The lock arm 25 pivots about its base end, which is the side connected with the upper surface of the female connector F. As a result, a clearance is formed between the lock 4 and the locking surface 3*b* of the engaging projection 3 even if the lock arm 25 is elastically or resiliently restored as the connectors F, M are connected properly with each other.

Opposite sides of the surface of the lock 4 that face the locking surface 3*b* are cut away to form two downwardly inclined slanted surfaces 4*b*. Two shake preventing surfaces 4*c* extend in forward and backward directions from the slanted surfaces 4*b* with a more moderate inclination and at the same width as the slanted surfaces 4*b* (FIG. 19). The shake preventing surfaces 4*c* can contact the bottom edges of the locking surface of the engaging projection 3. The length of the shake preventing surfaces 4*c* is set such that their leading ends reach an intermediate position of the bottom surface of the engaging projection 3 by passing beyond the bottom end of the locking surface 3*b*. Thus, even if the clearance between the lock 4 and the locking surface 3*b* varies, the shake preventing surfaces 4*c* can always contact the bottom edge of the locking surface 3*b*.

The terminal retainer 15 includes a front-stop wall 28 that can be held in close contact and substantially in alignment with the front surface of the housing head 14 when the terminal retainer 15 is fit into the housing body 9. Additionally, leading end surfaces of the female terminal fittings 5 are brought into contact with the front-stop wall 28. Male terminal insertion openings 29 are formed in the front-stop wall 28, and align with the respective cavities 16 and the windows 23. Alternatively, the terminal fittings may contact an inner surface of a front portion of the housing Fh instead of the front-stop wall 28.

Figure 12:
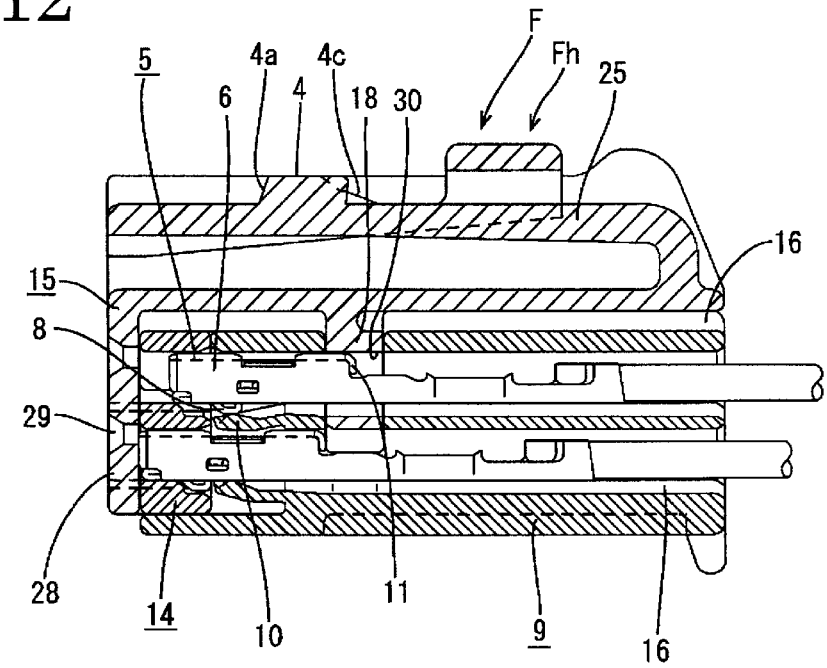
FIG. 12 is a side view in section showing an insertion process of terminal fittings when the terminal retainer is in a partial locking position.

The terminal lock 18 projects integrally down from the ceiling surface of the terminal retainer 15 along the entire width. As shown in FIG. 10, the front surface of the terminal lock 18 is a distance T from the inner surface of the front-stop wall 28. The distance T substantially equals the distance S in FIG. 2, which is entire length of the connecting portions 6 of the female terminal fittings 5 from the front surfaces of the connecting portions 6 to the rear surfaces of the contact pieces 11. The terminal lock 18 is formed with as many communication holes 30 as the cavities 16 at the upper stage of the housing body 9. As described later, when the terminal retainer 15 is mounted in its partial locking position on the housing body 9 (see FIG. 12), the respective communication holes 30 substantially align with the corresponding cavities 16 at the upper stage and portions below the opening edges of the communication holes 30 are at positions where they do not enter the cavities 16 at the lower stage. Thus, when the terminal retainer 15 is in its partial locking position, the female terminal fittings 5 can be inserted into the respective cavities 16 of the housing body 9. However, when the terminal retainer 15 is mounted in its full locking position on the housing body 9 (see FIG. 1), portions above and below the opening edges of the communication holes 30 enter the respective cavities 16 at the upper and lower stages. Thus, as long as the female terminal fittings 5 are inserted to their proper insertion positions against the front-stop wall 28, the terminal lock 18 can be engaged in close contact with the contact pieces 11 to prevent the female terminal fittings 5 from coming out backward.

A coupling projection 34 projects at the rear end of each side surface of the terminal retainer 15 and can be inserted into the corresponding guide groove 33 of the housing body 9.

Figure 14:
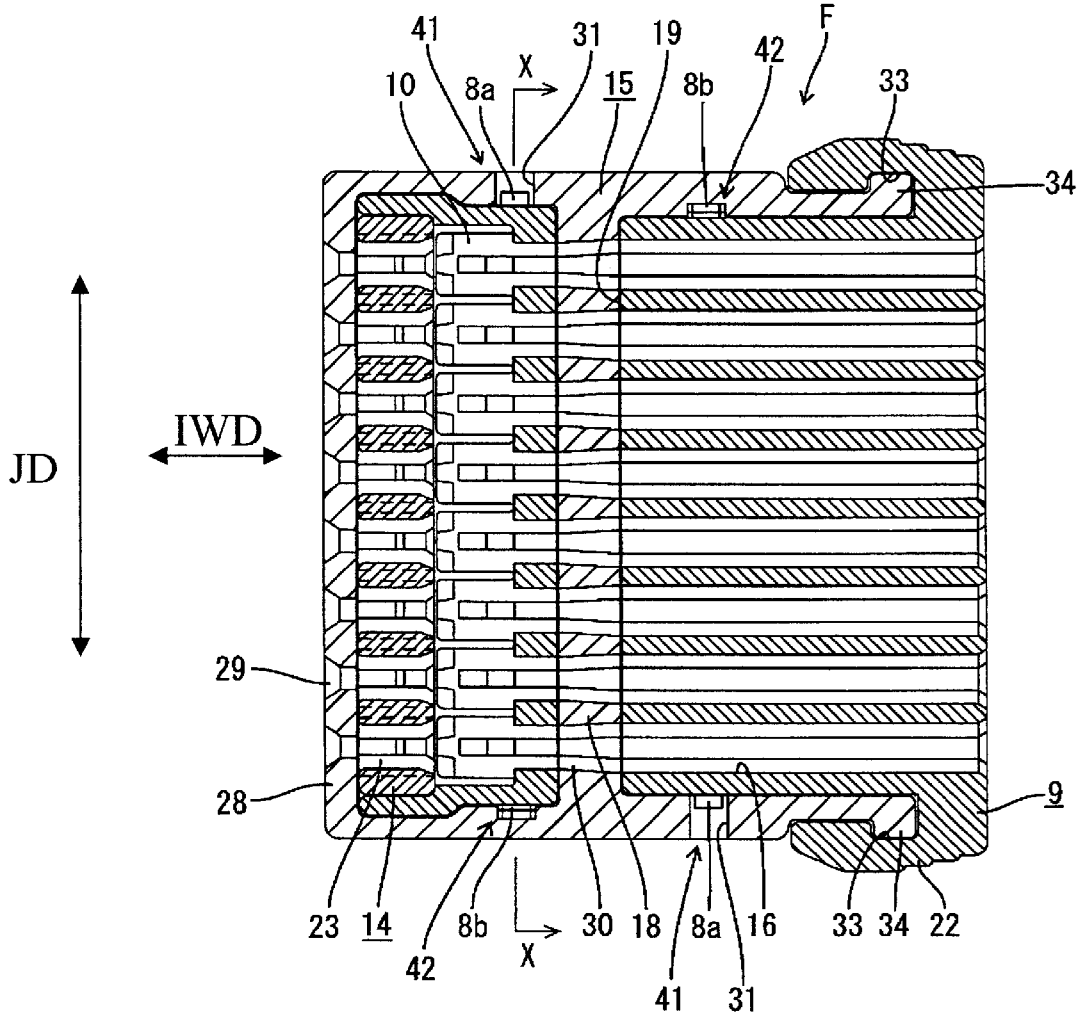
FIG. 14 is a plan view in section of the female connector housing.
Figure 15:
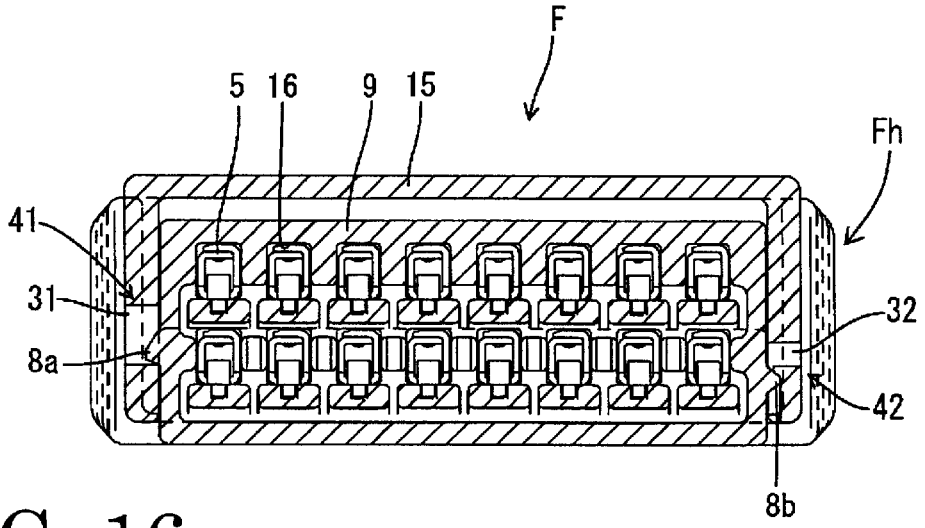
FIG. 15 is a section along 15—15 of FIG. 14 with the terminal retainer partially locked.
Figure 16:
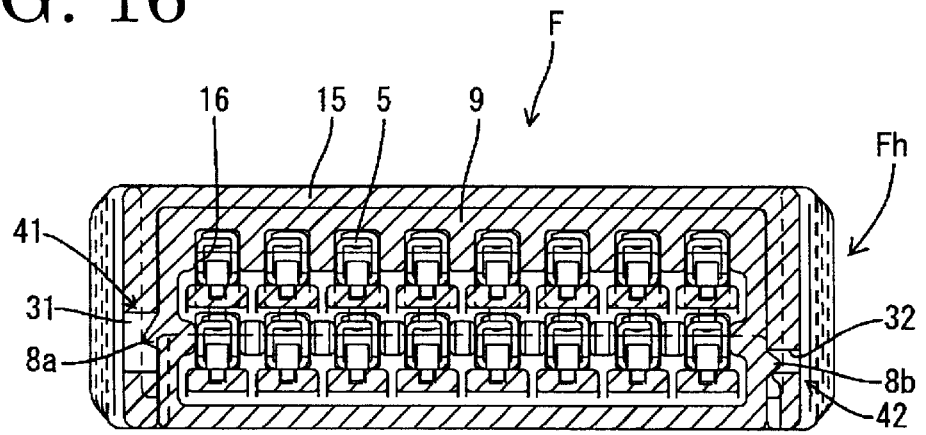
FIG. 16 is a section similar to FIG. 15, but with the terminal retainer fully locked.

Partial locking means 41 are provided for holding the terminal retainer 15 in its partial locking position and full locking means 42 are provided for holding the terminal retainer in its full locking position, as shown in FIGS. 6 and 14 to 18. More particularly, a pair of partial locking projections 8*a* and a pair of full locking projections 8*b* are formed on the opposite side surfaces of the main body 17 of the housing body 9, with each pair being spaced apart transversely, as shown in FIGS. 6 and 14. On the other hand, opposite side walls of the terminal retainer 15 are formed with partial locking holes 31 that correspond to the partial locking projections 8*a* and full locking holes 32 that correspond to the full locking projections 8*b*. The partial locking projections 8*a* and the partial locking holes 31 define the partial locking means 41, whereas the full locking projections 8*b* and the full locking holes 32 define the full locking means 42. The full locking means 42 also cooperate with the partial locking means 41 to hold the terminal retainer 15 in its partial locking position.

Figure 17:
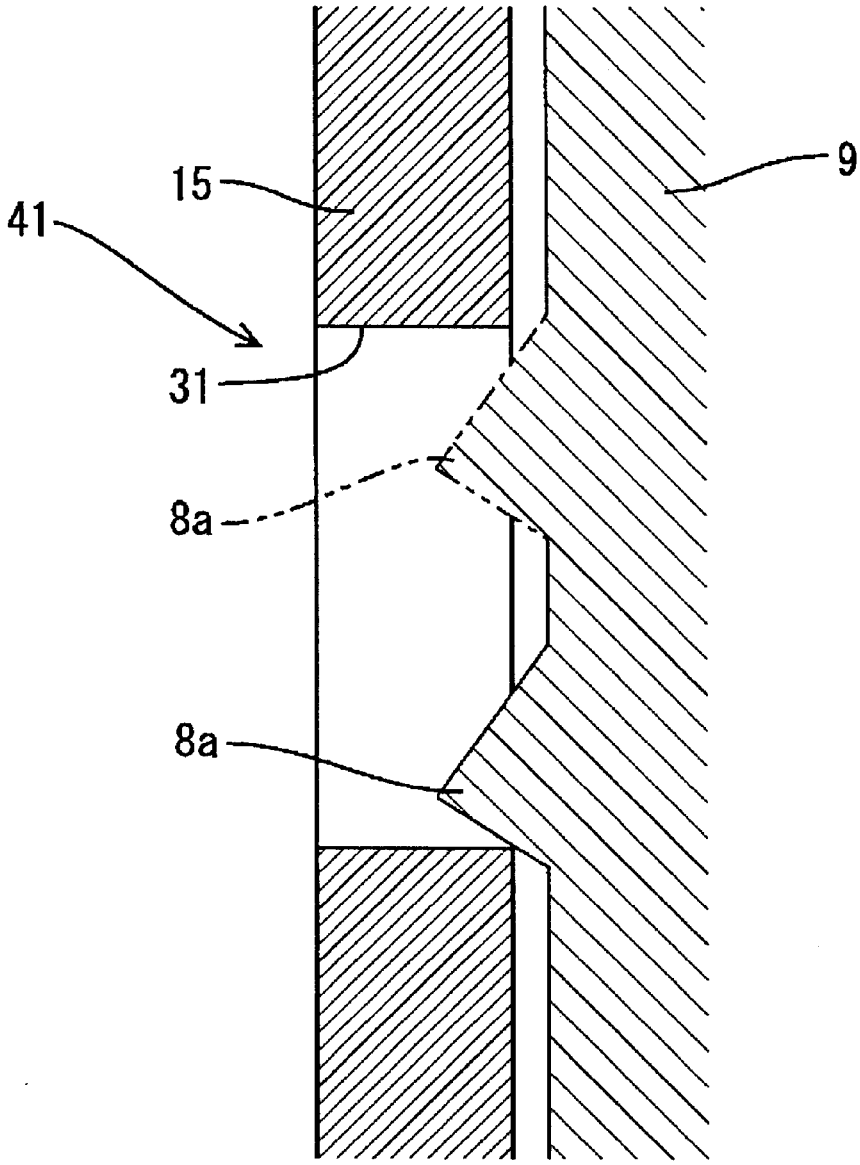
FIG. 17 is an enlarged side view showing partially and fully locked states in a first locking portion.
Figure 18:
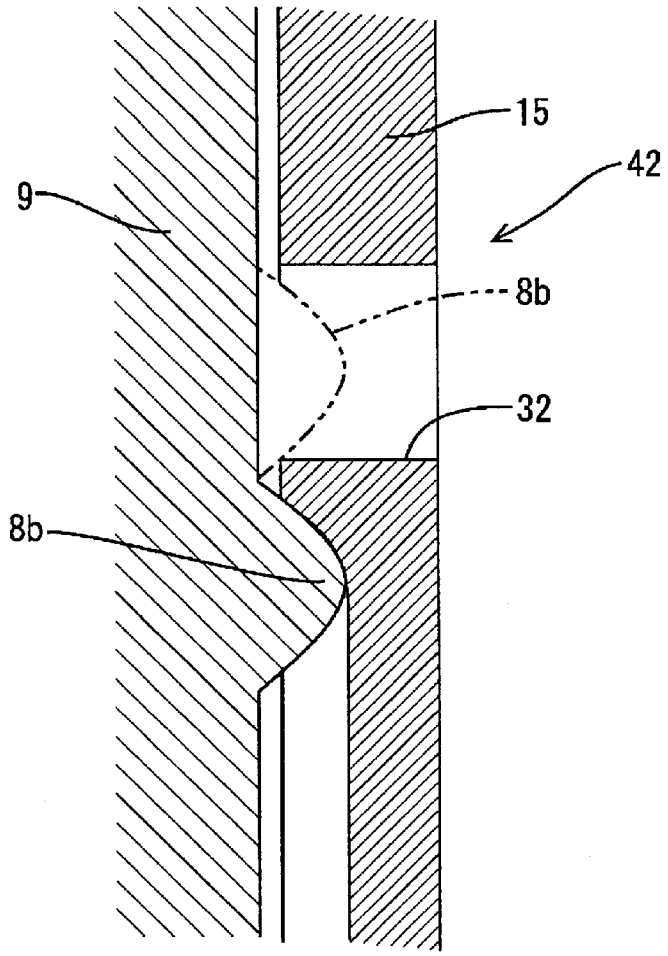
FIG. 18 is an enlarged side view showing partially and fully locked states in a second locking portion.

Each partial locking hole 31 is oblong along the height direction or an insertion and withdrawal direction of the retainer in and from the female housing Fh. As shown in FIG. 17, the corresponding partial locking projection 8*a* can be engaged with the bottom edge of the partial locking hole 31 when the terminal retainer 15 is in its partial locking position, while the partial locking projection 8*a* is at an intermediate position of the partial locking hole 31 when the terminal retainer 15 is in its full locking position (state shown by phantom line). On the other hand, as shown in FIG. 18, the full locking projection 8*b* is engaged with a step below the corresponding full locking hole 32 when the terminal retainer 15 is in its partial locking position, while being locked in the full locking hole 32 when the terminal retainer 15 is in its full locking position (state shown by phantom line).

The left and right partial locking means 41 (partial locking projections 8*a* and partial locking holes 31) are offset from each other in the insertion and withdrawal directions IWD of the female terminal fittings 5. More particularly, as shown in FIG. 6, the right partial locking means 41 is more forward with respect to the insertion direction of the female terminal fittings 5 than the left partial locking means 41. Additionally, the partial locking means 41 are arranged on opposite sides of the mount hole 19 with respect to the insertion and withdrawal directions IWD of the female terminal fittings 5.

The left and right full locking means 42 (full locking projections 8*b* and full locking holes 32) also are offset to each other in the insertion and withdrawal directions IWD of the female terminal fittings 5. More particularly, as shown in FIG. 6, the right full locking means 42 is more backward with respect to the insertion direction ID of the female terminal fittings 5 than the left full locking means 42. Additionally, the full locking means 42 are arranged on opposite sides of the mount hole 19 with respect to the insertion and withdrawal directions IWD of the female terminal fittings 5.

The partial locking means 41 is more forward (leftward in FIG. 14) with respect to the insertion direction than the full locking means 42 at the right side (upper side in FIG. 14). Conversely, the partial locking means 41 is more backward (rightward in FIG. 14) with respect to the insertion direction ID than the full locking means 42 at the left side (lower side in FIG. 14). When these four locking means 41, 42 are viewed from above, the two partial locking means 41 are arranged diagonally and the two full locking means 42 also are arranged diagonally in a phantom rectangle formed by connecting these locking means 41, 42. A diagonal line connecting the partial locking means 41 and the one connecting the full locking means 42 intersect with each other.

The female connector F is assembled by first accommodating the housing head 14 at least partly in the bulging portion 20 of the main body 17. At this time, the hooks 24 of the housing head 14 are engaged with the notches 21 of the main body 17 (in this case, they may be pushed in).

Figure 13:
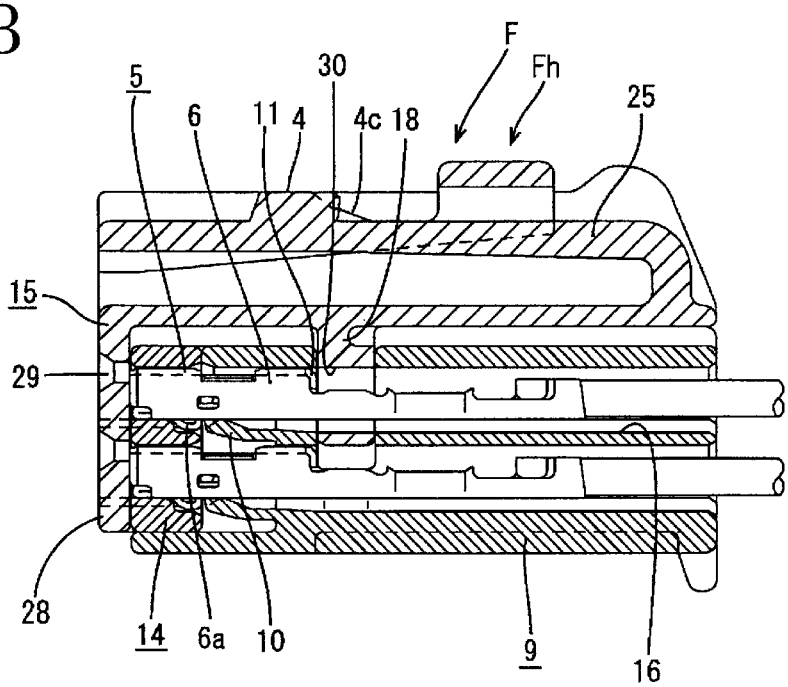
FIG. 13 is a side view in section showing a state when the insertion of the terminal fittings is completed.

The terminal retainer 15 then is fit into the housing body 9 assembled with the housing head 14 while aligning the coupling projections 34 with the guide grooves 33. During this time, the terminal lock 18 of the terminal retainer 15 is fit into the mount hole 19 of the main body 17. Then, the partial locking projections 8*a* are engaged with the partial locking holes 31 and the full locking projections 8*b* are engaged with the steps below the full locking holes 32. In this way, the terminal retainer 15 is prevented from moving up and down along its fitting direction into the housing body 9. Thus, the terminal retainer 15 is held in its partial locking position with respect to the housing head 14 and the housing body 9 (state shown in FIGS. 12, 13 and 15).

The cavities 16 substantially align with the communication holes 30 of the terminal retainer 15 in the partial locking position, but not with the male terminal insertion openings 29 in the front-stop wall 28. Additionally, the front-stop wall 28 is held in close contact with the front surface of the main body 17. Accordingly, the female terminal fittings 5 can be inserted from behind into the cavities 16 of the upper stage and can pass the communication holes 30. Similarly, the female terminal fittings 5 can be inserted from behind into the cavities 16 of the lower stage and can pass below the terminal lock 18. Further pushing causes the female terminal fittings 5 to pass the respective locks 10 while elastically or resiliently deforming the locks 10 down. The female terminal fittings 5 then contact the inner surface of the front-stop wall 28, and as a result, the front end positions of the inserted female terminal fittings 5 are determined. The respective locks 10 are restored resiliently to engage the locking projections 6*a* when the female terminal fittings 5 are inserted to their proper insertion positions. Thus, the female terminal fittings 5 are partly locked in the female connector F. Even though the terminal fittings 5 abut against the front-stop wall 28 of the terminal retainer 15 they may alternatively abut against an inner surface of a front portion of the female housing Fh (not shown).

After complete insertion of the female terminal fittings 5, the terminal retainer 15 is pushed into the housing body 9 and the housing head 14 until its ceiling surface contacts the upper surface of the main body 17. Thus, the partial locking projections 8*a* are moved to the intermediate positions of the partial locking holes 31 and the full locking projections 8*b* are engaged with the full locking holes 32. In this way, the terminal retainer 15 is held in its full locking position so as not to come out of the housing body 9. In the full locking position, the portions of the terminal lock 18 above and below the opening edges of the communication holes 30 enter the cavities 16 at the upper and lower stages and engage the contact pieces 11 of the female terminal fittings 5, as described above. At this stage, the male terminal insertion openings 29 of the front-stop wall 28 are aligned with the respective cavities 16.

If the female terminal fitting 5 is inserted to a position far before its proper insertion position, the terminal lock 18 interferes with the upper surface of the connecting portion 6, and it is impossible to push the terminal retainer 15. Thus, an operator can immediately notice an insufficient insertion of the female terminal fitting 5 and can insert it to its proper insertion position.

The terminal lock 18 closely engages the connecting portions 6 of the female terminal fittings 5 if the female terminal fittings 5 are inserted properly into contact with the front-stop wall 28. This assumes, however, that the female terminal fittings 5 are produced to specified dimensions since the distance from the front-stop wall 28 to the terminal lock 18 is set substantially equal to the length of the connecting portion 6 of the female terminal fitting 5.

The female terminal fittings 5 that have been locked doubly in the female connector F by the locks 10 and the terminal lock 18 can be connected with the male connector M. The sliding surface 4*a* of the locking projection 4 of the lock arm 25 contacts the engaging projection 3 of the male connector M as the two connectors F, M are fitted, and the lock arm 25 is deformed elastically or resiliently downward as they are further fitted. This causes the lock 4 to pass under the engaging projection 3 while being elastically restored to engage the engaging projection 3. As a result, the female and male connectors F, M are locked into each other. To effect unlocking, the operable piece 27 can be pushed to deform the lock arm 25 again, thereby disengaging the engaging projection 3 and the lock 4 from each other.

The bottom edge of the locking surface 3*b* is in contact with the upper surface of the shake preventing surfaces 4*c* while the lock 4 and the engaging projection 3 are engaged with each other. Thus, the female and male connectors F, M are prevented from shaking by frictional force acting between them. Accordingly, vibration from a vehicle that is transmitted to the connector causes no fine sliding movement or abrasion between the female and male terminal fittings 1, 5, and abrasion is prevented.

Further, the shake preventing surfaces 4*c* are slanted. Thus, the bottom edge of the engaging projection 3 and the shake preventing surfaces 4*c* can be held in contact with each other even if a clearance between the locking projection 4 and the engaging projection 3 varies.

As described above, the terminal retainer 15 is locked in the housing Fh in two positions spaced apart along the insertion and withdrawal directions of the female terminal fittings 5 in both the partial locking position and the full locking position. Thus, even if an external force acts on the terminal retainer 15 mounted in the housing Fh in the insertion or withdrawal direction of the female terminal fittings 5, the orientation of the terminal retainer 15 is not inclined in the insertion or withdrawal direction.

The pair of partial locking means 41 and the pair of full locking means 42 are arranged at the opposite sides of the engaging position of the terminal retainer 15 with the female terminal fittings 5. Therefore, the inclination of the terminal retainer 15 when an external force acts on the female terminal fittings in the insertion or withdrawal direction can be prevented.

The partial locking means 41 is more forward with respect to the insertion direction than the full locking means 42 at the one side, but is more backward with respect to the insertion direction than the full locking means 42 at the other side. In other words, the partial and full locking means 41, 42 are arranged so as not to interfere with each other in forward and backward directions as well as transverse direction. Thus, a higher degree of freedom in designing can be ensured for the arrangement of the respective locking means 41, 42.

The present invention is not limited to the above described and illustrated embodiments. For example, following embodiments are also embraced by the technical scope of the present invention as defined in the claims. Beside the following embodiments, various changes can be made without departing from the scope and spirit of the present invention as defined in the claims.

The pair of locking means are positioned at the opposite sides of the engaging position of the terminal retainer with the terminal fittings with respect to the insertion and withdrawal directions of the terminal fittings in the foregoing embodiment. However, both of the pair of locking means may be provided more forward than the engaging position or more backward than the engaging position.

The terminal retainer is held in the partial locking position and in the full locking position with respect to the housing in the connector of the foregoing embodiment. However, the present invention is also applicable to connectors in which the terminal retainer is not held in the partial locking position.

The partial locking means is more backward than the full locking means at the left side of the housing while being located more forward than the full locking means at the right side in the foregoing embodiment. However, it may be located more forward than the full locking means at the left side of the housing while being located more backward than the full locking means at the right side according to the present invention.

Although the female connector is provided with the terminal retainer in the foregoing embodiment, the male connector may be provided with the terminal retainer according to the present invention.

Although the housing body is comprised of the main body and the housing head in the foregoing embodiment, the housing body may have an integral or unitary construction according to the present invention.

What is claimed is:

1. A connector, comprising:

a housing, terminal fittings inserted substantially side by side in the housing, a terminal retainer mounted in the housing and engaging the terminal fittings to prevent the terminal fittings from coming out of the housing, and at least one pair of spaced apart locking means formed on at least one of the housing and the terminal retainer, the locking means being spaced apart and configured to lock the terminal retainer in the housing, the locking means being arranged in two positions spaced apart from each other in insertion and withdrawal directions of the terminal fittings into and from the housing, the locking means comprising a pair of full locking means for holding the retainer in a full locking position where the terminal retainer engages the terminal fitting to prevent the terminal fittings from coming out of the housing and a pair of partial locking means for holding the terminal retainer in a partial locking position where insertion and withdraw of the terminal fittings into and from the housing are permitted, the partial locking means being located more forward with respect to the insertion direction than the full locking means at one side of the housing and being locating more backward with respect to the insertion direction than the full locking means with respect to a juxtaposed side of the housing.

2. A connector according to claim 1, wherein the pair of locking means are at the opposite sides of an engaging position of the terminal retainer with the terminal fittings with respect to the insertion and withdrawal directions of the terminal fittings.

3. A connector according to claim 1, wherein the terminal retainer comprises a terminal lock provided in a position such that a distance from a front stop wall of the retainer to a front surface of the terminal lock is substantially equal to an entire length of a connecting portion of the terminal fitting.

4. A connector according to claim 3 wherein at least one of the partial locking means and the full locking means comprise a pair of locking projections on one of the retainer and the housing and a locking hole provided on the other of the retainer and the housing, the locking projections cooperating with the locking hole in the partial and full locking position of the retainer.

5. A connector according to claim 4, wherein the locking hole is oblong along an insertion and withdrawal direction of the retainer in and from the female housing, wherein a corresponding partial locking projection is engageable with a bottom edge of the corresponding locking hole when the terminal retainer is in its partial locking position while being located at an intermediate position of the locking hole when the terminal retainer is in its full locking position, and wherein a corresponding full locking projection is engageable with a step below the corresponding locking hole when the terminal retainer is in its partial locking position while being locked in the locking hole when the terminal retainer is in its full locking position.

6. A connector according to claim 1, wherein the housing comprises at least one lock arm resiliently engageable with a mating connector for locking the connector with the mating connector, wherein the lock arm comprises a locking projection having at least one shake preventing portion for avoiding a shaking of the connectors by contacting a portion of the mating connector.

7. A connector according to claim 6, wherein the shake preventing portions comprise slanted surfaces.

8. A connector, comprising:

a housing having opposite front and rear ends, a top, a bottom and first and second sides, a plurality of cavities extending through the housing from the front end to the rear end, a mount hole extending into the top of the housing rearward of the front end and intersecting the respective cavities;

a terminal retainer mounted on the housing and having a terminal lock extending into the mount hole of the housing; and a first partial locking means on the first side of the housing and forward of the mount hole, a second partial locking means on the second side of the housing and rearward of the mount hole, a first full locking means on the first side of the housing rearward of the mount hole and a second full locking means on the second side of the housing forward of the mount hole, the first and second partial locking means being for locking the retainer in a position on the housing where terminal fittings are insertable into the cavities, the first and second full locking means being for locking the retainer in a position on the housing for locking terminal fittings in the cavities between the terminal lock of the retainer and the front of the housing.

9. The connector of claim 8, wherein the retainer further comprises a front lock wall adjacent the front of the housing for limiting forward movement of the terminal fittings in the cavities.

* * * * *